United States Patent [19]

Helm

[11] 3,977,283

[45] Aug. 31, 1976

[54] ROTARY PANEL CUTTER FOR CUTTING OPENINGS IN A WEB

[75] Inventor: Herbert W. Helm, Hollidaysburg, Pa.

[73] Assignee: F. L. Smithe Machine Company, Inc., Duncansville, Pa.

[22] Filed: June 25, 1975

[21] Appl. No.: 590,160

[52] U.S. Cl. ..... 83/341; 83/346; 83/669; 83/911

[51] Int. Cl.[2] ..... B26F 1/00

[58] Field of Search ..... 83/341, 669, 670, 911, 83/346, 50, 55, 667

[56] References Cited

UNITED STATES PATENTS

| | | | |
|---|---|---|---|
| 1,087,953 | 2/1914 | Kenny | 83/667 X |
| 1,948,081 | 2/1934 | Silver, Jr. | 83/50 |
| 3,011,377 | 12/1961 | Monck | 83/911 X |
| 3,106,121 | 10/1963 | Novick | 83/341 X |
| 3,527,127 | 9/1970 | Stovall | 83/341 X |

*Primary Examiner*—Frank T. Yost
*Attorney, Agent, or Firm*—Stanley J. Price, Jr.; John M. Adams

[57] ABSTRACT

The rotary panel cutter includes a cutter die that has a continuous upstanding knife blade. The cutter die has a body portion that is secured to a rotatable cutter shaft having a longitudinal axis. The cutter die knife blade has side edge portions that are perpendicular to the longitudinal axis of the cutter shaft and leading and trailing edge portions that are not parallel to the longitudinal axis of the cutter shaft. For cutting rectangular openings in a web the continuous upstanding knife blade has the configuration of a regular parallelogram wherein the length of side edges is the same and the length of the leading and trailing edges is also the same. The rotatable cutter shaft is mounted in a machine frame with its longitudinal axis at an angle other than 90° with the center line of the web. The angle that the rotatable cutter shaft deviates from 90° is preferably the same angle as the angle of deviation of the knife leading and trailing edges from the longitudinal axis of the cutter shaft. An anvil backing device, such as a rotatable anvil, is positioned adjacent to the rotatable cutter shaft and has an outer surface spaced from the rotary cutter die an amount slightly less than the thickness of the web material being cut. The longitudinal axis of the anvil is parallel to the longitudinal axis of the rotatable cutter shaft. A suitable conveying device, such as pull rolls, pull the web through the panel cutter between the cutter shaft and anvil and rotation of the rotatable panel cutter shaft cuts openings, such as windows, in the web.

8 Claims, 8 Drawing Figures

ROTARY PANEL CUTTER FOR CUTTING OPENINGS IN A WEB

BACKGROUND OF THE INVENTION

1. Field of the Invention

This invention relates to a rotatable panel cutter for cutting openings in a web and more particularly to a rotatable cutter die having knife side edge portions perpendicular to the longitudinal axis of the rotatable cutter shaft.

2. Description of the Prior Art

Envelopes are conventionally formed from precut envelope blanks having a configuration that includes side flaps, a bottom flap and a closure flap. The envelope blanks are conventionally advanced in succession into a panel cutting mechanism that cuts one or more openings or windows in the body of the envelope blank. Where the envelope blanks are formed from an endless web, it has been the practice in the past to provide panel cutter devices where the cutter shaft and anvil are arranged at an angle of 90° to the center line of the web. Where envelope blanks are formed from an endless web, cutter dies having irregular configurations were required to cut windows or openings in the web before envelope blanks were cut from the web. For example, U.S. Pat. No. 1,111,751 discloses a rotary cutter for cutting eliptical panels in a web before the envelope blanks are severed from the web. The envelope blanks formed in this manner have a generally diamond shape and the eliptical windows are cut at an angle to the side edges of the web. The cutter die disclosed in this patent is limited to the eliptical configuration illustrated therein and the eliptical panels cut in the web are limited to the particular envelope blank configuration disclosed therein.

U.S. Pat. Nos. 3,106,121; 3,257,885; and 3,465,626 disclose panel cutter devices that are employed with severed envelope blanks and are arranged to form one or more rectangular windows therein. These patents discuss positioning the generally rectangular die at an angle to the axis of the panel cutter shaft and also feeding the blanks into the rotary panel cutter at substantially the same angle to provide progressive cutting of the panel in the blank and further to properly orient the panel in parallel relations to the edges of the envelope. In all of these patents, the cutter die has a rectangular configuration to form the rectangular panels in the envelope blank. It was discovered that the generally rectangular cutter dies previously employed in forming panels in envelope blanks did not form rectangular panels in a web of material when the panel cutter dies were positioned to progressively cut the panels in the web. There is a need for a rotary panel cutter and particularly a rotary panel cutter die that is operable to cut windows or openings of a desired configuration in a web as the web is conveyed through the rotatable panel cutter.

SUMMARY OF THE INVENTION

This invention relates primarily to a rotary cutter die for cutting windows or openings in a web. The cutter die has a continuous upstanding knife blade with a pair of spaced side edges, a leading edge and a trailing edge. For cutting rectangular openings, the knife side edge portions have the same length and are arranged parallel to each other. The knife leading edge portion has the same length as the trailing edge portion and is positioned in spaced parallel relation thereto. The leading and trailing edge portions extend at equal oblique angles to the knife side edge portions.

The rotary cutter die has a longitudinal axis with the knife leading and trailing edges parallel thereto. The cutter die is arranged to be mounted on a rotatable cutter shaft that has a longitudinal axis. The cutter die is mounted on the cutter shaft with the cutter die longitudinal axis at an angle to the longitudinal axis of the rotary cutter shaft. The cutter die knife side edges are arranged perpendicular to the longitudinal axis of the rotatable cutter shaft. The rotary cutter shaft is mounted in a frame with its axis of rotation at an angle to the transverse axis of the web. The angle between the axis of the cutter shaft and the transverse axis of the web is equal to the angle between the longitudinal axes of the cutter shaft and the cutter die. Where the cutter die continuous knife blade has the configuration of a rhomboid or parallelogram, the panels or windows formed in the web have the configuration of a regular rectangle and the cutting action between the cutter die knife blade on the web is a progressive cutting action.

Accordingly, the principal object of this invention is to provide a rotatable cutter die that will progressively cut panels in a moving web.

Another object of this invention is to provide a rotatable panel cutter for progressively cutting one or more panels or windows in a moving web.

These and other objects and advantages of this invention will be more completely disclosed and described in the following specification, the accompanying drawings and the appended claims.

DESCRIPTION OF THE PREFERRED EMBODIMENT

Figure 2:
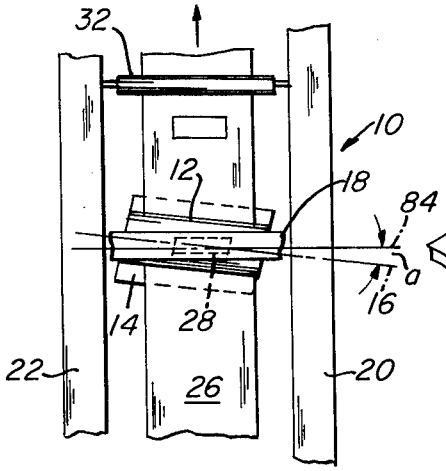
FIG. 2 is a schematic top plan view of a rotary panel cutter, illustrating the panel cutter shaft and anvil mounted at an angle to the transverse axis of the web and the angular configuration of the cutter die knife leading and trailing edge portions.
Figure 1:
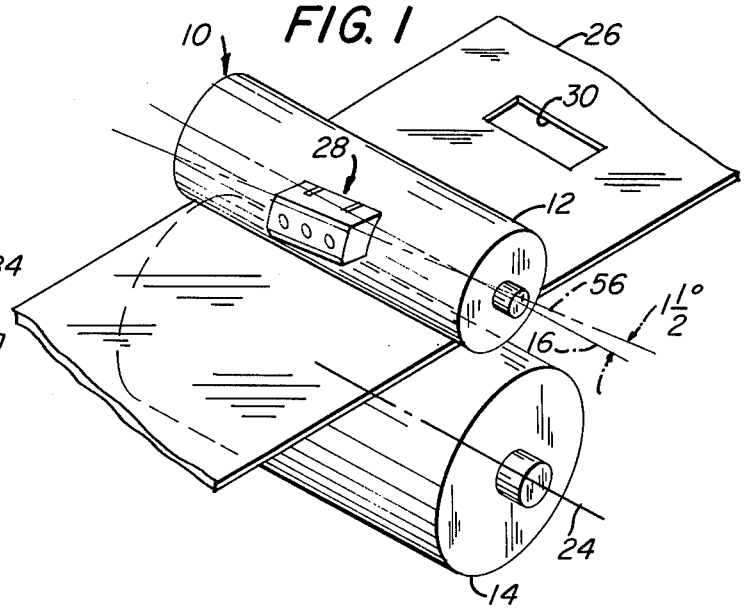
FIG. 1 is a diagrammatic perspective view of the rotary panel cutter, illustrating the rotary cutter shaft and anvil mounted at an angle to the transverse axis of the web and further illustrating the configuration of the rotary die with the side edge portions of the knife perpendicular to the longitudinal axis of the cutter shaft and the leading and trailing edges of the knife at an angle to the longitudinal axis of the cutter shaft.

Referring to the drawings, there is illustrated a rotatable panel cutter assembly generally designated by the numeral 10 that includes a rotatable panel cutter shaft 12 and a rotatable backing anvil 14. Although a rotatable backing anvil 14 is illustrated it should be understood that other types of backing anvils such as the stationary bar-type anvil illustrated in U.S. Pat. No. 3,380,327 may be used.

The rotatable cutter shaft 12 has a longitudinal axis 16 and is rotatably mounted in a bridge member 18 diagrammatically illustrated in FIG. 2. The bridge member 18 is in turn supported by machine side frames 20 and 22. The rotary anvil 14 is preferably rotatably mounted on the bridge member 18 and has its longitudinal axis 24 parallel to the longitudinal axis 16 of cutter shaft 12. Suitable drive means (not shown) are provided to rotate the cutter shaft 12 and, where desired, anvil 14 at a preselected speed relative to the speed of the web 26 so that the rotary panel cutter die generally designated by the numeral 28 mounted on the cutter shaft 12 will progressively cut a succession of spaced windows or openings 30 in web 26.

The web 26 is conveyed through the rotary panel cutter at a preselected speed by any suitable conveying means such as pull rolls 32 diagrammatically illustrated in FIG. 2. With this arrangement the web 26 is conveyed through the panel cutter assembly 12 between the rotatable cutter shaft 12 and the anvil 14 by means other than the rotation of the panel cutter shaft 12. Thus the movement of the web 26 is dependent on a conveying means other than the rotation of the panel cutter shaft 12. The rotatable panel cutter die generally designated by the numeral 28 is illustrated in detail in FIGS. 3, 4 and 5. It should be understood that the panel cutter die may have configurations other than that illustrated, as for example a separate continuous knife blade secured to a block member as is illustrated in U.S. Pat. No. 3,257,885, without departing from the scope of the presently described invention. The essential feature of the cutter die is the angular relation between the knife blade side edge portions and the knife blade leading and trailing edge portions. The angular relation of the cutter die to the axis of the cutter shaft also provides the progressive cutting hereinafter described. It is, therefore, within the scope of this invention to utilize the knife edge configuration on other cutter die configurations.

The cutter die 28 has a body portion 34 with a plurality of longitudinal bores 36, 38 and 40 therethrough. The bores have countersunk recessed portions 42 to receive the heads of bolts that secure the cutter die 28 to the rotatable cutter shaft 12. The cutter die 28 has an upper surface 44 with a continuous upstanding knife blade generally designated by the numeral 46 extending upwardly therefrom. The continuous knife blade 46 has a pair of side edge portions 48 and 50, a leading edge portion 52 and a trailing edge portion 54.

In the embodiment illustrated the side edge portions 48 and 50 are parallel to each other and the leading and trailing edge portions 52 and 54 are also parallel to each other. The intersection of the side edge portions and the front and trailing edge portions are at angles other than at 90° to each other as will be later discussed in reference to FIGS. 7 and 8.

Figure 3:
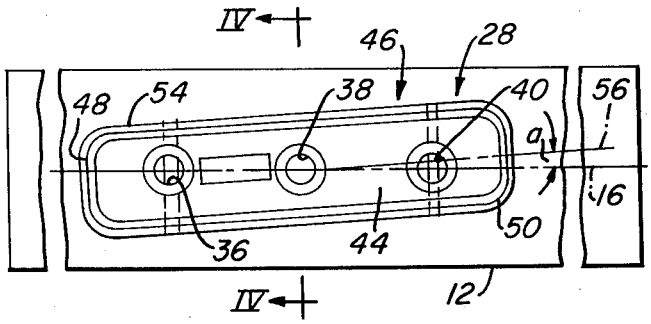
FIG. 3 is a top plan fragmentary view of the cutter shaft with the cutter die mounted thereon, illustrating the angular configuration of the continuous knife blade and the manner in which the cutter die is mounted on the shaft.

In FIG. 3 the cutter shaft 12 with its longitudinal axis 16 is illustrated. The cutter die 28 has a longitudinal axis 56 which is parallel to the knife leading and trailing edge portions 52 and 54. Bores 58 are provided in cutter shaft 12 to receive bolts extending through the respective bores 36 – 40 in the cutter die 28 to mount the cutter die 28 on the shaft 12 so that the cutter die knife edge portions are perpendicular to the center line of the shaft 12 and the knife leading and trailing edge portions 52 and 54 are not parallel thereto. The angular relationship between the longitudinal axis of shaft 16 and the axis of cutter die 28 is illustrated in FIG. 3 and designated by the letter *a.*

Figure 4:
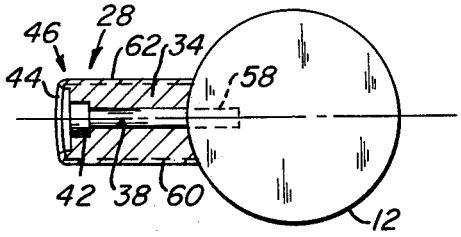
FIG. 4 is a view in section taken along the line IV—IV of FIG. 3, illustrating in section the cutter die mounted on the rotatable cutter shaft.

The particular cutter die 28 illustrated in FIGS. 3 and 4 has a configuration to cut a rectangular window in the web wherein one dimension of the window is greater than the other. In this instance the leading and trailing edge portions of the window are substantially longer than the window side edge portions. It should be understood, however, where a square window or panel is desired the side edge portions may have the same dimension as the knife leading and trailing edge portions to form a square window in the web.

Figure 5:
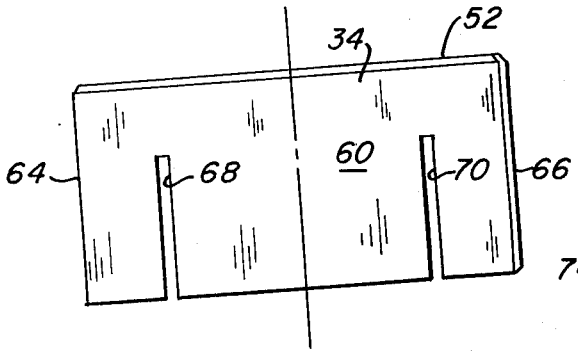
FIG. 5 is a projected view in side elevation of the cutter die, illustrated in FIG. 3.

The cutter die body portion 32 illustrated in FIGS. 4 and 5 has a leading edge wall 60, a trailing edge wall 62 and side walls 64 and 66. Elongated vertical slots 68 and 70 are formed in the die body portion 34 parallel to the side walls 64 and 66 and extend upwardly to a preselected location spaced from the body portion upper surface. The slotted portions 68 and 70 are arranged to provide a relief at the ends of the side edges of cutter blade 46. As will be noted in FIG. 3 the blade outer edge portions are formed along a radius to progressively cut the web and progressively abut a surface of the anvil 14. It has been determined as described in U.S. Pat. No. 3,257,885 that relief of the edges of the knife provides improved progressive cutting and prolongs the life of the cutting blade. When the cutter die 28 is being sharpened, shims having a thickness of about 0.001 inches are positioned under the die body portion 34 between the slots 68 and 70 and the side walls 64 and 66. After sharpening is completed and the shims are removed the knife blade of the cutter die when mounted on the rotatable cutter shaft 12 will have a relief of 0.001 inches adjacent the side walls 66 and 68.

Figure 6:
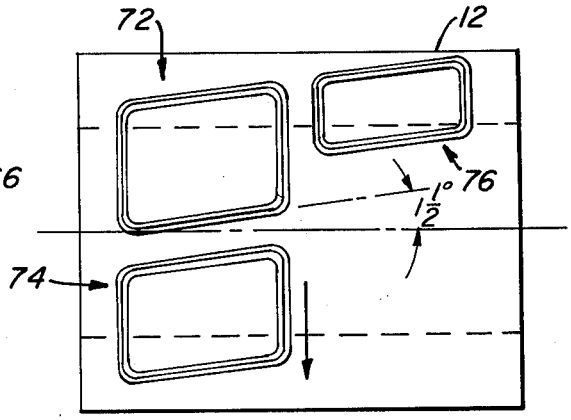
FIG. 6 is a generally diagrammatic view of a plurality of cutter dies mounted on a rotatable cutter shaft to progressively cut a plurality of panels or windows in a web.

As illustrated in FIG. 6 a plurality of rotary cutter dies generally designated by the numerals 72, 74 and 76 are positioned on the rotatable cutter shaft 12 adjacent to each other and the plurality of cutter dies are arranged to cut three panels in the web 26. It should be noted that all of the cutter dies 72 – 76 have upstanding knife blades with a parallelogram configuration and have the blade side edges perpendicular to the longitudinal axis of the rotary cutter shaft 12 and the knife blade leading and trailing edges arranged at an oblique angle to the longitudinal axis of the cutter shaft.

It should be understood that the same cutter die configuration may be employed where the rotatable cutter shaft has a holder positioned thereon and the cutter die body portion is similar to that illustrated in U.S. Pat. No. 3,257,885. It should be noted also that the above-described cutter die 28 and rotatable cutter shaft 12 do not include suction means conventionally used with rotary panel cutters. The rotary panel cutter die herein described may, however, be utilized with conventional suction devices and the suction device may be incorporated in both the die 28 and the rotary panel cutter shaft 12.

Figure 7:
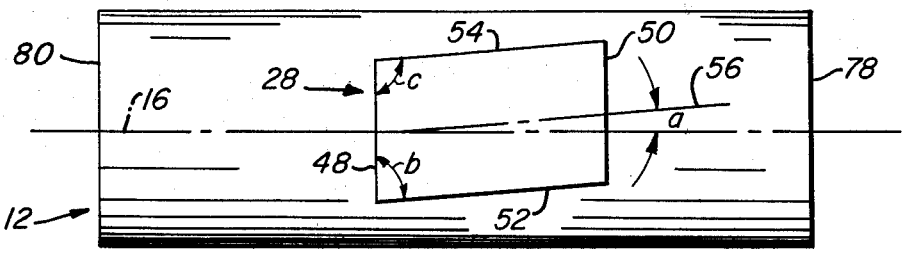
FIG. 7 is a schematic view of the cutter shaft with the cutter die mounted thereon, illustrating schematically the angular deviation of the leading and trailing edge portions of the cutter die knife blade and the perpendicular relation of the cutter die knife blade side edges to the longitudinal axis of the cutter shaft.
Figure 8:
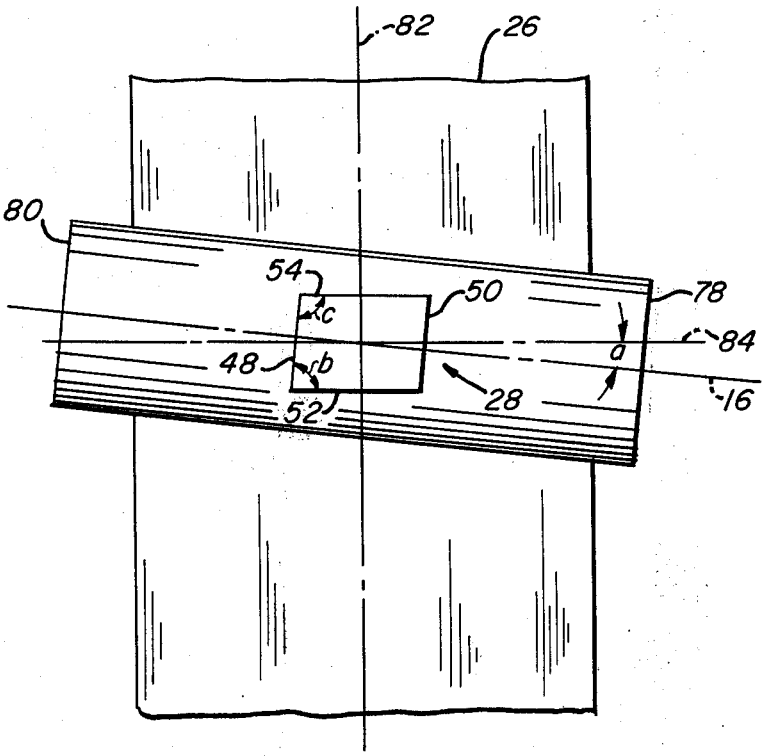
FIG. 8 is a schematic diagram similar to FIG. 7, wherein the rotatable cutter shaft is positioned in overlying relation with a web and at an angle to the transverse axis of the web.

Referring to FIGS. 7 and 8 there is schematically illustrated in FIG. 7 the manner in which the cutter die 28 is mounted on the rotatable cutter shaft 12 and the angular relation of the cutter die knife leading and trailing edges 52 and 54 to the longitudinal axis of the rotatable cutter shaft 12 is illustrated. For convenience in discussing the angular relation of the cutter die knife side edges 48 and 50 the end walls of the rotatable cutter shaft 12 will be designated by the numerals 78 and 80. The cutter die 28 is mounted on the rotatable cutter shaft 12 with the knife side edges 48 and 50 perpendicular to the cutter shaft longitudinal axis 16 and parallel to the cutter shaft end walls 78 and 80. The cutter die leading and trailing knife edges 52 and 54 are parallel to each other and to the cutter die longitudinal axis 56. The knife leading and trailing edges 52 and 54 and the cutter die longitudinal axis 56 are positioned at an angle to the cutter shaft longitudinal axis 16 designated by the letter *a* in FIGS. 3 and 7.

With this arrangement the cutter die knife leading and trailing edges 52 and 54 are angularly displaced from the longitudinal axis 16 of rotatable cutter shaft 12 and the cutter die knife side edges 48 and 50 are arranged perpendicular to the cutter shaft longitudinal axis 16. With this arrangement the angle of intersection between the cutter die knife side edge 48 and knife leading edge 52 is an acute angle designated by the letter *b* in FIG. 7 and the angle of intersection between the knife side edge 48 and the trailing edge 54 is an obtuse angle designated by the letter *c*.

The configuration of the knife edges is illustrated in FIG. 7 is that of a rhomboid with the side edges parallel to each other and the leading and trailing edges parallel to each other.

FIG. 8 illustrates the manner in which the rotary cutter shaft 12 with the rotary cutter die 28 mounted thereon is mounted in the bridge 18 relative to the web 26. In FIG. 8 the web 26 has a longitudinal axis or center line 82 and a transverse axis 84 which is perpendicular to the longitudinal axis 82. The cutter shaft 12 is mounted relative to the web 26 with the cutter shaft longitudinal axis 16 at an angle to the web transverse axis 84. The angle between the respective axes 16 and 84 is the same as the angle between the cutter die axis 56 and cutter shaft axis 16 as illustrated in FIG. 7. The rotary anvil 14 is also mounted at the same angle *a* to the transverse axis 84 of web 26.

With this arrangement although the cutter die side edges 48 and 50 are parallel to the cutter shaft side walls 78 and 80, the side edges 48 and 50 are not parallel to the web longitudinal axis 28 or to the edges of the web. Further, although the cutter die leading and trailing edges 52 and 54 are not parallel to the cutter shaft longitudinal axis 16 when the cutter shaft 12 is mounted as illustrated in FIG. 8, the knife leading and trailing edges 52 and 54 are perpendicular to the web longitudinal axis 82 and parallel to the web transverse axis 84. The cutter die knife side edges 48 and 50 generate cutting lines in the web 26 which are parallel to the web longitudinal axis 82 and the web side edge portions. The angular relation of the cutter knife side edges provide the progressive cutting as previously discussed. Although the angular relation between the cutter shaft longitudinal axis 16 and the web transverse axis 84 is designated as about 1½° and illustrated for clarity at 5° it should be understood that angles other than 1½° may be employed to obtain the desired progressive cutting and parallel side edge cuts in the web as above discussed.

According to the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. A rotary panel cutter for cutting openings in a web comprising, a cutter die having a continuous upstanding knife blade with a pair of spaced side edge portions, a leading edge portion and a trailing edge portion, said side edge portions positioned parallel to each other, said leading edge portions positioned in spaced parallel relation to said trailing edge portion, said cutter die having a longitudinal axis parallel to said knife blade leading edge portion and trailing edge portion, said leading edge portion and said trailing edge portion extending at oblique angles to said side edge portions, and said cutter die leading edge and trailing edge portions arranged to be positioned perpendicular to the longitudinal axis of a web while cutting openings in the web.

2. A rotary panel cutter for cutting openings in a web as set forth in claim 1 in which, said side edge portions have the same length and a length less than the length of said leading edge portion.

3. A rotary panel cutter for cutting openings in a web as set forth in claim 1 which includes, a rotary cutter shaft having a longitudinal axis, said cutter die mounted on said cutter shaft with said pair of spaced side edge portions perpendicular to said cutter shaft longitudinal axis.

4. A rotary panel cutter for cutting openings in a web as set forth in claim 1 which includes, a rotary cutter shaft having a longitudinal axis, said cutter die mounted on said rotatable cutter shaft with said cutter die longitudinal axis at an acute angle to said rotatable cutter shaft longitudinal axis.

5. A rotary panel cutter for cutting openings in a web as set forth in claim 1 which includes, a rotary cutter shaft having a longitudinal axis, an anvil having a longitudinal axis, said anvil positioned adjacent to said rotary cutter shaft with said rotary cutter shaft longitudinal axis parallel to said anvil longitudinal axis.

6. A rotary panel cutter for cutting openings in a web as set forth in claim 5 in which, said rotary cutter shaft and said anvil are arranged to receive a web member having a longitudinal axis and a transverse axis therebetween.

7. A rotary panel cutter for cutting openings in a web as set forth in claim 1 in which, said rotary cutter shaft longitudinal axis is arranged to be positioned at an acute angle to the transverse axis of a web while said cutter die is cutting openings in the web.

8. A rotary panel cutter for cutting openings in a web as set forth in claim 1 in which, said cutter die knife blade side edge portions are arranged to be positioned at an acute angle to the longitudinal axis of a web while said cutter die is cutting openings in the web.

* * * * *